US010837245B2

(12) United States Patent
Ali et al.

(10) Patent No.: US 10,837,245 B2
(45) Date of Patent: Nov. 17, 2020

(54) LINER HANGER SYSTEM

(71) Applicant: Saudi Arabian Oil Company, Dhahran (SA)

(72) Inventors: Syed Muhammad Ali, Abqaiq (SA); Yassar Kamal Zia, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 224 days.

(21) Appl. No.: 16/021,811

(22) Filed: Jun. 28, 2018

(65) Prior Publication Data

US 2020/0003019 A1 Jan. 2, 2020

(51) Int. Cl.
*E21B 43/10* (2006.01)
*E21B 43/08* (2006.01)
*E21B 23/02* (2006.01)

(52) U.S. Cl.
CPC ..... *E21B 23/02* (2013.01); *E21B 43/08* (2013.01)

(58) Field of Classification Search
CPC ..... E21B 43/08; E21B 43/10; E21B 23/006; E21B 23/00; E21B 23/02
See application file for complete search history.

(56) References Cited

U.S. PATENT DOCUMENTS 2,681,111 A * 6/1954 Thompson ..... E21B 43/086 166/235
3,253,655 A 5/1966 Brown
3,279,539 A 10/1966 Brown et al.
3,382,927 A 5/1968 Davis, Jr.
3,450,204 A 6/1969 Brown et al.
3,608,634 A 9/1971 Cochran
4,096,913 A 6/1978 Kenneday et al.
4,281,711 A 8/1981 Braddick et al.
4,603,743 A 8/1986 Lindsey, Jr.
4,606,408 A 8/1986 Zunkel et al.
4,669,538 A 6/1987 Szarka
4,796,706 A * 1/1989 Townsend ..... E21B 23/01 166/380
4,828,291 A * 5/1989 Mitchell ..... E21B 17/06 166/278
4,862,966 A 9/1989 Lindsey et al.
(Continued)

FOREIGN PATENT DOCUMENTS

EP 1712729 A2 10/2006
WO WO-2008/135538 A2 11/2008
(Continued)

OTHER PUBLICATIONS

International Search Report for PCT/IB2018/056521 (Liner Hanger System, filed Aug. 27, 2018) issued by ISA/EPO, 6 pages (dated Mar. 21, 2019).
(Continued)

*Primary Examiner* — Kenneth L Thompson
(74) *Attorney, Agent, or Firm* — Choate, Hall and Stewart LLP; Charles E. Lyons, DPhil; Peter Flynn

(57) ABSTRACT

An example liner hanger system includes a casing for lining a wellbore and a collar configured for connection to a part of the casing within the wellbore. The collar has a first shape and a liner hanger has a second shape that is based on the first shape. The liner hanger is configured to fit within, and to be supported by, the collar. The system also includes a screen connected to the liner hanger.

10 Claims, 5 Drawing Sheets

(56) References Cited

U.S. PATENT DOCUMENTS

| | | | | |
|---|---|---|---|---|
| 4,942,925 | A | 7/1990 | Themig | |
| 5,033,551 | A * | 7/1991 | Grantom | E21B 23/06 166/181 |
| 5,922,975 | A * | 7/1999 | Butler | E21B 49/084 73/864.74 |
| 6,189,617 | B1 * | 2/2001 | Sorhus | E21B 37/00 166/311 |
| 6,749,020 | B1 * | 6/2004 | Knight | E21B 17/0423 166/235 |
| 6,799,645 | B2 | 10/2004 | Mason et al. | |
| 6,877,567 | B2 | 4/2005 | Hirth | |
| 7,066,265 | B2 | 6/2006 | Surjaatmadja | |
| 7,647,990 | B2 | 1/2010 | Tessari et al. | |
| 8,066,069 | B2 | 11/2011 | Giroux et al. | |
| 8,511,392 | B2 | 8/2013 | Howlett et al. | |
| 8,662,164 | B2 | 3/2014 | Watson | |
| 8,739,890 | B2 | 6/2014 | Noffke | |
| 8,839,870 | B2 | 9/2014 | Ring | |
| 9,249,640 | B2 | 2/2016 | Noffke et al. | |
| 9,447,661 | B2 * | 9/2016 | Broussard | E21B 43/04 |
| 9,725,991 | B2 * | 8/2017 | Novelen | E21B 43/084 |
| 9,822,612 | B2 | 11/2017 | Steele et al. | |
| 2003/0221829 | A1 | 12/2003 | Patel et al. | |
| 2004/0221984 | A1 | 11/2004 | Cram | |
| 2006/0260795 | A1 | 11/2006 | Rescia | |
| 2008/0115944 | A1 | 5/2008 | Coon et al. | |
| 2019/0345785 | A1 * | 11/2019 | Fleckenstein | E21B 4/006 |

FOREIGN PATENT DOCUMENTS

| | | | |
|---|---|---|---|
| WO | WO-2016/018223 | A1 | 2/2016 |
| WO | WO-2017/164869 | A1 | 9/2017 |
| WO | WO-2020/002976 | A1 | 1/2020 |

OTHER PUBLICATIONS

Written Opinion for PCT/IB2018/056521 (Liner Hanger System, filed Aug. 27, 2018) issued by ISA/EPO, 7 pages (dated Mar. 21, 2019).

Baker Hughes, Liner Hanger Systems, 2 pages (2018). URL: https://www.bhge.com/upstream/completions/liner-hanger-systems [Retrieved Jul. 31, 2018].

Hajjan Drilling Co., Slip-Pad Stop-Sand, 1 page (2018). URL: http://www.hajjandrilling.com/stopsand4.php [Retrieved Jul. 31, 2018].

TIW, EJ-IB-TC Mechanical Set Liner Hanger, Brochure 4 pages (2018). URL: http://www.tiwoiltools.com/ej-ib-tc-mechanical-hanger.html [Retrieved Jul. 31, 2018].

TIW, Liner Hanger Systems, Brochure, 5 pages (2018). URL: http://www.tiwoiltools.com/liner-hanger-systems.html [Retrieved Jul. 31, 2018].

Weatherford International, Liner Hangers, Suspend liner loads from the casing, 1 page (2018). URL: http://www.weatherford.com/en/products-services/well-construction/liner-systems/liner-hangers [Retrieved Jul. 31, 2018].

International Preliminary Examination Authority Written Opinion for PCT/IB2018/056521, 5 pages (dated May 8, 2020).

* cited by examiner

LINER HANGER SYSTEM

TECHNICAL FIELD

This specification relates generally to examples of a liner hanger system.

BACKGROUND

A casing string may be installed in a wellbore to line, and to maintain the integrity of, the wellbore. One or more casings may be installed, sequentially, in a wellbore to form the casing string. Installing a casing string in a wellbore may include drilling a first hole having a first diameter and installing a first casing configured to line the length of the first hole. The first casing may be cemented into the well. Another hole may be drilled from the first hole. The other hole may have a second, smaller diameter. Drilling may occur through the casing lining the first hole. A second casing is configured to line the length of the second hole. The second casing may be installed at or near the end of the first casing string using a liner hanger. A liner hanger forms a joint between the first and second casings. The liner hanger may be considered part of the casing string.

SUMMARY

An example liner hanger system includes a casing for lining a wellbore and a collar configured for connection to a part of the casing within the wellbore. The collar has a first shape and a liner hanger has a second shape that is based on the first shape. The liner hanger is configured to fit within, and to be supported by, the collar. The system also includes a screen connected to the liner hanger. The example system may include one or more of the following features, either alone or in combination.

The first shape may include a cylindrical shape that tapers from top to bottom. The second shape may include a cylindrical shape that tapers from top to bottom. The first shape may be at an interior profile of the collar. The second shape may be at an exterior profile of the liner hanger.

The system may be installed in a wellbore that may be for a vertical water well. The screen may be configured to allow water to pass through the screen but to prevent at least some particulate matter from passing through the screen. The system may include a setting tool configured to connect to the liner hanger to attach the liner hanger to the collar. The setting tool may include a pipe that is runnable downhole within the wellbore. The setting tool may be configured to connect to the liner hanger using a J-slot mechanism. The J-slot mechanism may include two J-slot structures configured to oppose each other on an inner profile of the liner hanger. The system may include an anchor that is extendible from opposing sides of a shaft of the setting tool and that is configured to engage the two J-slot structures. The screen may include first threads. The liner hanger may include second threads. The second threads may be complementary to the first threads. The system may include a liner hanger that is not cemented within the wellbore.

An example method includes attaching a screen to a liner hanger and connecting a setting tool to the liner hanger that has the screen attached. The example method includes running the setting tool connected to the liner hanger into a wellbore. The setting tool is run in the wellbore to a point proximate to an end of a casing lining the wellbore. The casing includes a collar located proximate to the end of the casing. The example method includes securing the liner hanger to the collar and releasing the setting tool from the liner hanger. The example method may include one or more of the following features, either alone or in combination.

Releasing may include applying downward force to the setting tool and, while downward force is applied, rotating the setting tool. The wellbore may be for a vertical water well. The screen may line at least part of a production zone of the vertical water well. Connecting the setting tool to the liner hanger may include connecting an anchor located on the setting tool to a J-slot mechanism on an inside of the liner hanger. Releasing the setting tool from the liner hanger may include applying downward force to the setting tool and rotating the setting tool in order to release the anchor from the J-slot mechanism.

An outer profile of the liner hanger may have a first shape that is based on a second shape of an inner profile of the collar. The outer profile of the liner hanger may have a first shape that is complementary to a second shape of an inner profile of the collar. The setting tool may be configured to connect to the liner hanger using a J-slot mechanism. The J-slot mechanism may include two J-slot structures opposing each other on an inner profile of the liner hanger.

Any two or more of the features described in this specification, including in this summary section, can be combined to form implementations not specifically described in this specification.

The systems, techniques, and processes described in this specification, or portions of the systems, techniques, and processes, can be controlled by a computer program product that includes instructions that are stored on one or more non-transitory machine-readable storage media, and that are executable on one or more processing devices to control (for example, to coordinate) the operations described in this specification. The systems, techniques, and processes described in this specification, or portions of the systems, techniques, and processes, can be implemented as an apparatus, method, or system that can include one or more processing devices and memory to store executable instructions to implement various operations.

The details of one or more implementations are set forth in the accompanying drawings and the description below. Other features and advantages will be apparent from the description and drawings, and from the claims.

DESCRIPTION OF THE DRAWINGS

Like reference numerals in different figures indicate like elements.

DETAILED DESCRIPTION

Figure 1:
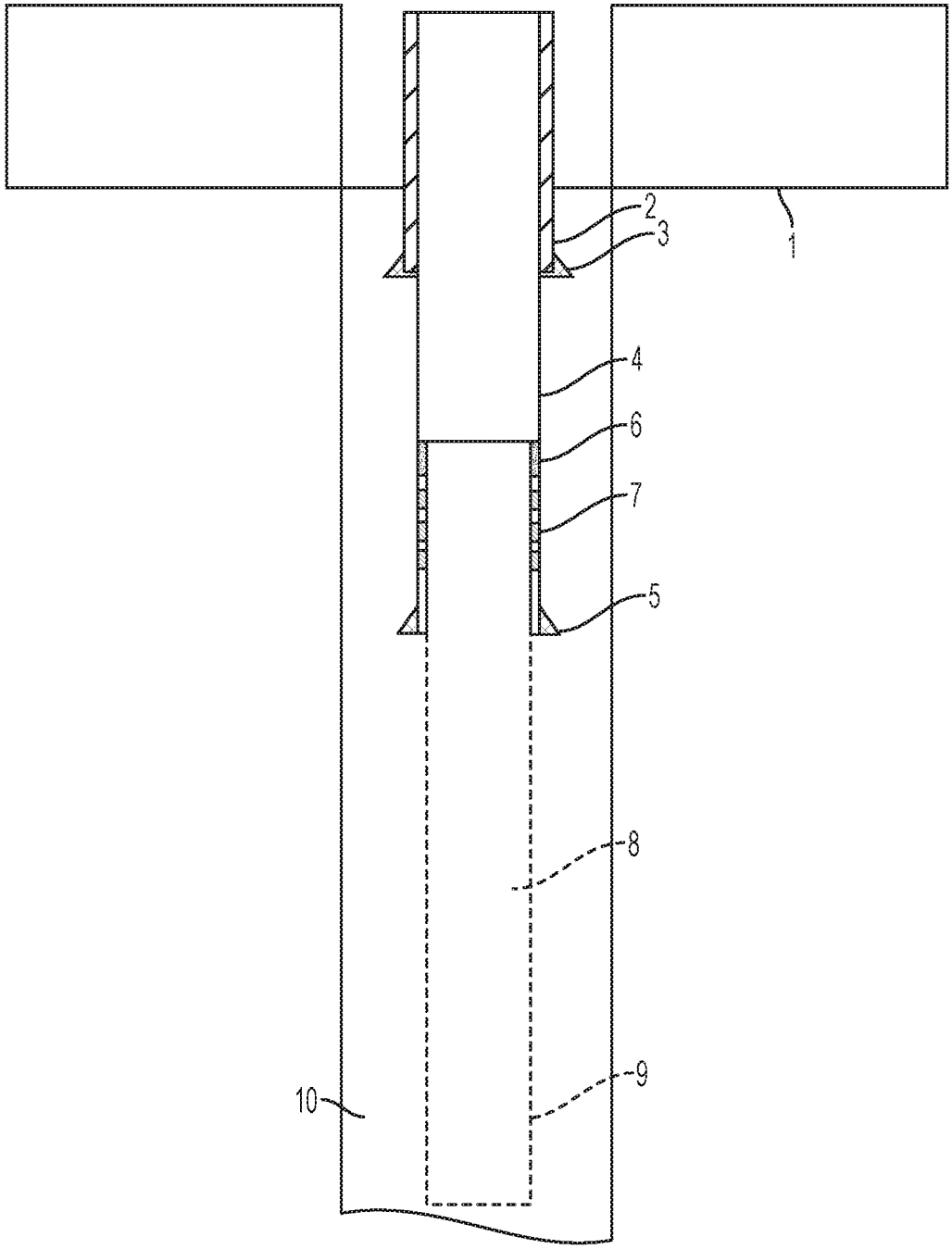
FIG. 1 is a cut-away, side view of components of an example casing string and a screen in a well.

Described in this specification are example liner hanger systems, and example methods for installing and retrieving the liner hanger systems. In this regard, liner hanger systems may be used to attach one or more casings or casing strings sequentially in a wellbore, and to attach a screen to line a completion zone of a well. A completion zone may be located near or span across an aquifer in order to produce water from the wellbore. A casing string may include multiple casings that are connected in sequence. The examples described in this specification apply to both individual casings and casing strings. However, the examples are described in the context of casing strings.

Liner hangers secure segments of the casing string together, forming joints, as the wellbore narrows. Liner hangers, once installed, resist forces exerted on the casing string to maintain wellbore integrity during production. For example, water entering the wellbore and being pumped to the surface may be turbulent and may exert forces within the casing strings. The connection of a liner hanger to the casing sections resists these forces to keep the casing strings secured within the wellbore.

A liner hanger may be configured to attach, or to hang, one or more casing strings from the internal wall of a downhole casing. A setting tool may be used to carry the liner hanger, including an attached casing string and screen, downhole to a point near the end of an installed casing. The installed casing may be a component of a casing string that is furthest downhole or may be an individual casing. The setting tool may be used to connect the liner hanger to a part of the installed casing. The setting tool may then be released and the liner hanger, including the casing string and the screen, may remain downhole attached to the installed casing.

In an example, the connection downhole between the liner hanger and part of the installed casing is a taper or stab-in connection. A stab-in connection between two components is a connection in which a second component fits within the shape of a first component. The stab-in connection between a liner hanger and a part of the installed casing may be achieved by applying force to the liner hanger to fit tightly within the part of the installed casing. This stab-in connection produces a seal between sequential casing segments that may be able to withstand forces during production. The stab-in connection may be between a collar located on a casing string and the liner hanger. The collar may be configured for connection to a part of the casing within the wellbore. The collar may have a first shape and the liner hanger may have a second shape that is based on the first shape. The liner hanger may be configured to fit within, and be supported by, the collar. The shape may include a taper of the first shape of the collar to match a taper of the second shape of the liner hanger. The first shape may be an interior profile of the collar and may be a cylindrical shape that tapers from top to bottom. The second shape may be an exterior profile of the liner hanger and may be a cylindrical shape that tapers from top to bottom.

The setting tool may be connected to the liner hanger at a surface The setting tool may be configured to connect to the liner hanger using a mechanical connection. In an example, the mechanical connection may include a J-slot. The setting tool may be disconnected from the liner hanger by applying downward force on the setting tool and by rotating the setting tool in order to release the setting tool from the liner hanger.

The setting tool may also be used to retrieve a liner hanger and connected components from downhole. To retrieve a liner hanger from downhole, the setting tool is run downhole to the site of the liner hanger. The setting tool may be attached to the liner hanger by rotating the setting tool to engage, and to fit within, the J-slot of the liner hanger. An upward force may then be applied to the liner hanger to release the liner hanger and to carry the liner hanger and connected components to the surface.

FIG. 1 shows a system that includes components of an example casing string installed in a vertical well. The system includes casing 2 having casing shoe 3 installed. Casing 2 extends from a ground level of formation 1. Casing shoe 3 is at the end of the casing string. Casing shoe 3 may be a collar and may be connected using a threaded connection. Casing shoe 3 may be configured to guide the casing into the wellbore using a rounded outer profile. In this example, the next casing to be installed—for example, from casing 2—is casing 4. In this example, casing 4 is run separately inside casing 2 and includes a casing shoe 5. The outer diameter of casing 4 may therefore be configured to fit within the inner diameter of casing 2. A screen 8 may also be installed at the end or slightly above the end of the casing string 4. In the example of a vertical water well, the screen may be installed in the well's production zone.

In the example of FIG. 1, screen 8 is connected to casing string 4, slightly above casing shoe 5. In this example, the connection is secured using liner hanger slips 7, which form a fitted connection to casing shoe 5. Liner hanger slips 7 may extend outwardly to strengthen the connection of casing string 4 to screen 8. Screen 8 also includes a shoe 9 that extends to completion zone 10 of the well. Screen 8 may line completion zone 10 of the well. Screen 8 may help maintain the integrity of the well, while allowing for water production through the screen. Unlike individual casings in a string, screens, such as screen 8, are typically not cemented in order to allow fluid from completion zone 10 to flow through the screen and into, and up through, the well. The screen may be configured to allow water to pass through the screen but to prevent particulate matter from passing through the screen.

An example screen may include multiple segments, called screen segments. Different screen segments may have the same length or different lengths. Different screen segments may be made of the same materials or of different materials. Two screen segments may be interconnected using a threaded connection. For example, each screen segment may have threads at both of its ends. Two screen segments may be connected through complementary threads. A screen, comprised of one or more screen segments, may be attached to the liner hanger in any appropriate manner. For example, the screen may have first threads and the liner hanger may have second threads that are complementary to the first threads. The first and second threads may mate, resulting in the connection of the screen to the liner hanger.

In the system of FIG. 1, liner top packer 6 seals segments of the casing string so that production fluid, such as water, flows through the casing string to the surface and does not escape into the wellbore. Liner top packer 6 may also prevent unwanted materials from the formation or cement from entering the interior of the casing string. In operation, liner top packer 6 may form a seal between casing segments using an elastomeric material or O-ring on the outer surface of the liner top packer. In another example, a sealing sleeve or a material configured to expand once placed within a casing string may be included on liner top packer 6 to form the seal.

Figure 2:
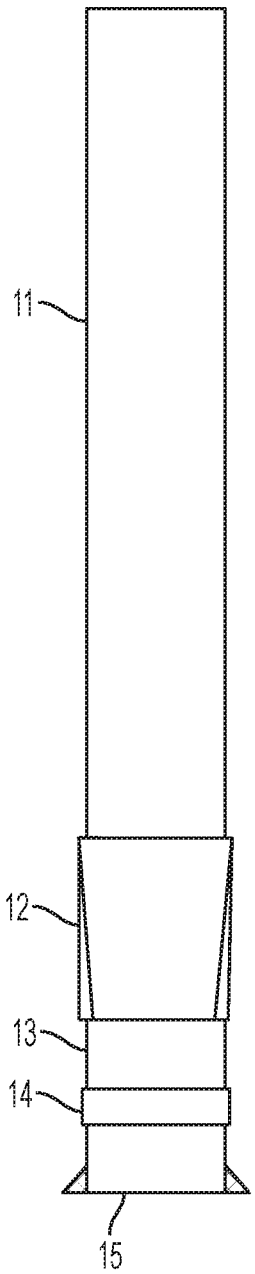
FIG. 2 is a cut-away, side view of components of an example casing string.
Figure 3:
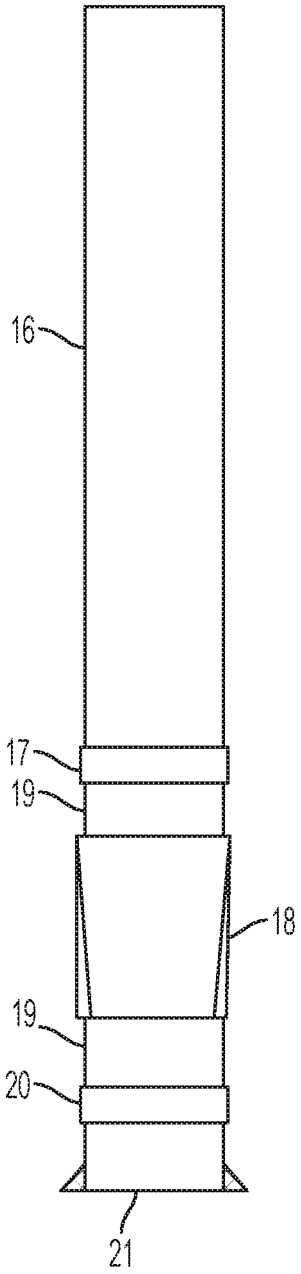
FIG. 3 is a cut-away, side view of components of an example casing string.

FIGS. 2 and 3 show example casing strings 11 and 16, which are similar to casing string 4 in FIG. 1. Casing string 11 and 16 may be used to line a wellbore and may be configured to connect to and to hang a screen to line completion zone 10. FIGS. 2 and 3 show additional components that could be installed on a casing string in order to form a connection with a screen to line completion zone 10 and aid the installation of the casing string in the wellbore. In FIG. 2, example casing string 11 includes setting seat collar 12. Setting seat collar 12 may be used to connect casing string 11 to another casing string or to a screen. Setting seat collar 12 may be connected to casing string 11 by a threaded connection. For example, setting seat collar 12 may be placed slightly above and screwed into the shoe track of casing string 11 or 16 using threads along the inner surface of the shoe track that mate to threads on the outer profile of setting seat collar 12. Casing string 11 extends past setting seat collar 12 to a segment 13. Segment 13 includes a float collar 14 and float shoe 15. Float collar 14 may attach to the outside of the casing and may include a valve to inhibit the flow of fluids or cement into the casing string 11 when the casing string 11 is downhole. Float shoe 15 may include a valve to inhibit the flow of fluids or cement into the casing string 11 when the casing string 11 is downhole and may guide casing string 11 into the wellbore during installation. Casing string 11 and the components on casing string 11 shown in FIG. 2 may be designed for a 13⅜ inch diameter casing string and include a 13⅜ inch diameter float shoe 15.

FIG. 3 shows another example of a casing string that may be hung in a wellbore having similar components to the components of casing string 11 in FIG. 2. Casing string 16 includes setting seat collar 18 and float collar 20. In addition, casing string 16 includes landing collar 17. Landing collar 17 is located near the end of the casing string 16, uphole of setting seat collar 18 and float collar 20. Landing collar 17 may act as a stop during cementing operation. Casing string 16 extends past setting seat collar 18 to include a segments that includes float collar 20 and float shoe 21. Casing string 16 may also include pup joints 19 to adjust the casing length. Float collar 20 may attach to the outside of casing string 16 and may include a valve to inhibit the flow of fluids or cement into the casing string when the casing string is downhole. Float shoe 21 may include a valve to inhibit the flow of fluids or cement into the casing string when the casing string is downhole and may help to guide the casing into the wellbore during installation. Casing string 16 and the components on casing string 16 of FIG. 3 may be designed for a 9⅝ inch diameter casing string and include a 9⅝ inch diameter float shoe 21.

Figure 4:
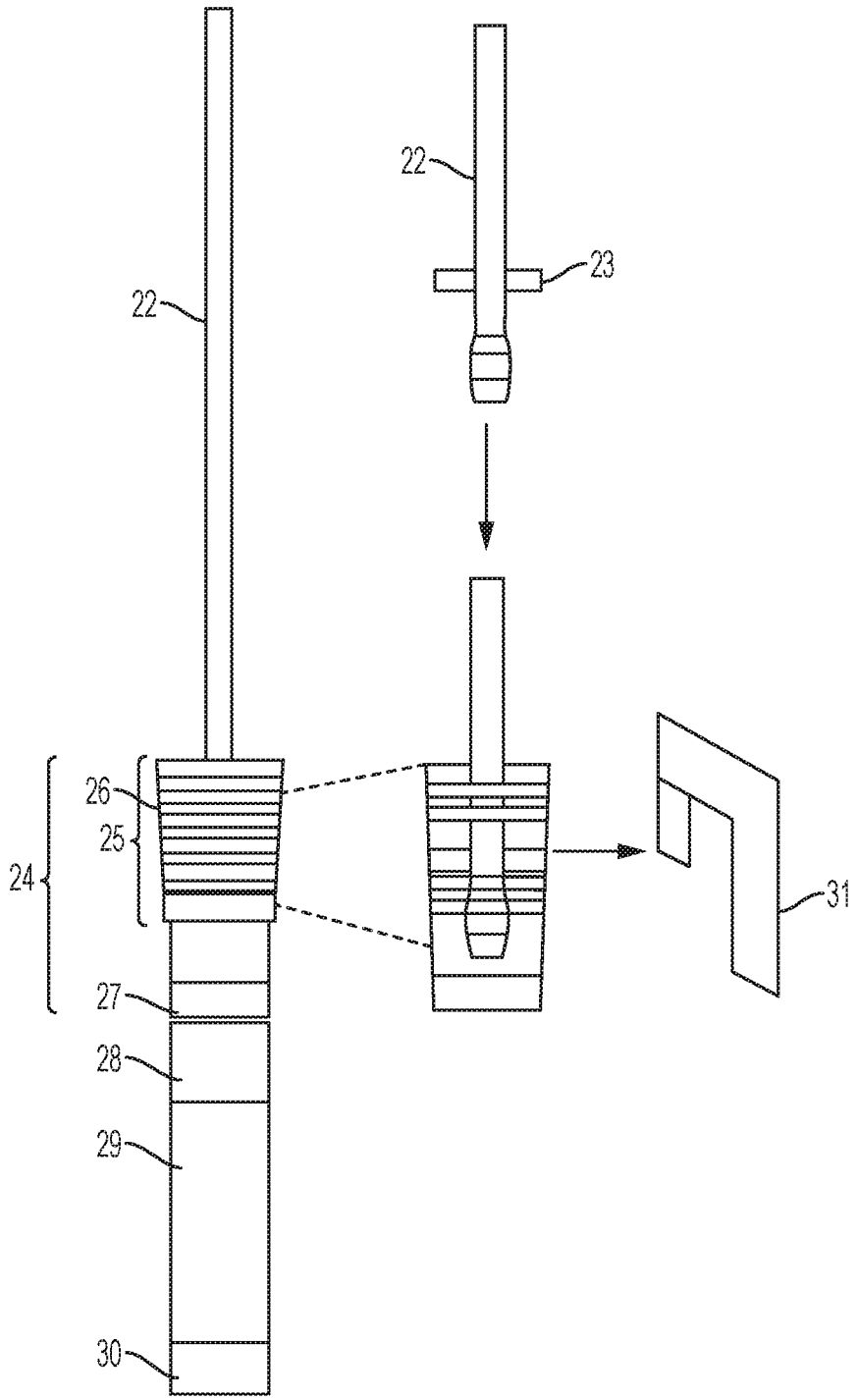
FIG. 4 is a cut-away, side view of components of an example liner hanger system.

FIG. 4 shows components of an example liner hanger system that may be used to attach a screen onto a casing string installed in a wellbore, such as casing string 4 in FIG. 1 or casing strings 11 and 16 of FIGS. 2 and 3, respectively. The liner hanger system may also be used to attach another casing string onto a casing string installed in a wellbore. Components of example liner hanger system include, but are not limited to, setting tool 22, liner hanger 24, and screen 29. Setting tool 22 includes an anchor 23, and is configured to connect to liner hanger 24. Anchor 23 is configured to engage, and to connect to, J-slot 31 located on the inner profile of liner hanger 24. The liner hanger system is configured to attach to screen 29. Liner hanger 24 includes threads 27 at one end to form a threaded connection with threads 28 of screen 29. In examples where the liner hanger is attaching another casing string rather than a screen, the casing string may attach to liner hanger 24 through a similar threaded connection. Screen 29 may be connected to another screen segment through a threaded connection using threads 30.

Liner hanger 24 outer profile 25 is configured to match the inner profile of a setting seat collar on a previously installed casing string. Liner hanger may connect to a setting seat collar, such as setting seat collar 12 shown in FIG. 2 or setting seat collar 18 shown in FIG. 3. In the example of FIG. 4, liner hanger 24 is a stab-in liner hanger having an outer profile 25 that includes ridge-like structures 26. In this example, outer profile 25 is cylindrical shape in shape and tapers from top to bottom. Outer profile may include, but is not limited to one or more ridge-like structures 26 as shown in FIG. 4. Ridges may be any height and spacing along the outer profile of the liner hanger and may be configured to match the inner profile of a setting seat collar. Outer profile may be a smooth surface having no ridges that is configured to match and to fit within a smooth inner profile of a setting seat collar. The outer diameter of the liner hanger may match the inner diameter of the collar to form a stab-in connection.

A setting seat collar may be configured for connection to a part of the casing within the wellbore and have a first shape. The first shape is not limited to the shape of setting seat collars 12 and 18 in FIGS. 2 and 3, respectively. Liner hanger 24 may have a second shape that is based on the first shape of the setting seat collar. Liner hanger 24 may be configured to fit within, and to be supported by, the setting seat collar. A setting seat collar, such as setting seat collar 12 or 18, and liner hanger 24 may connect to form an interference fit between the outer profile surface of the liner hanger and the inner profile surface of the setting seat collar. The interference fit may produce a frictional force between the two surfaces that is greater than a predicted force that a fluid in a well will generate on the liner hanger during production.

The connection between the liner hanger and setting seat collar of an uphole casing string may be maintained during fluid production in a well. In some cases, the connection should be of sufficient strength to resist forces on the assembly during fluid production in the well. The type of connection may depend on the type of well or conditions in the well. The type of connection may depend on the type of fluid being produced. The type of connection may depend on the predicted forces expected to be exerted on the assembly. In a vertical water well, predicted forces may include the expected water pressure exerted on the assembly.

A setting tool may be connected to a liner hanger via a mechanical connection, such as a J-slot. A J-slot may be configured as a cut-out or slotted region within a portion of a liner hanger profile. The J-slot may be curved or geometric in shape, such as the shape of a "J". A J-slot may provide a connection mechanism that allows for rotational connection and disconnection. An anchor, such as a protrusion on a setting tool, may be configured to slide within the J-slot to form a connection. In an example, a J-slot connection may include two J-slots on opposite sides of the liner hanger profile. An anchor, such as anchor 23 of FIG. 4, may include two protrusions opposite each other and configured to engage and to move within the J-slots of liner hanger 24. Protrusions on anchor 23 may include two pins extending from opposite sides of setting tool 22. The pins may retract within the setting tool upon contacting the inner profile of liner hanger 24. Protrusions of anchor 23 may extend upon reaching the J-slots to extend into the J-slots. Rotational force exerted on setting tool 22 rotates anchor 23 to slide the protrusions within the J-slots into a locked position. An upward force may be applied to setting tool 22 and anchor 23 to move extensions to the end of the J-slot and into a locked position.

Unlocking anchor 23 from J-slots may be performed by a movement opposite to a movement of locking the anchor within the J-slots. In an example, a downward force may be applied to the setting tool followed by or simultaneously with a rotational force in order to slide the protrusions of anchor 23 within the J-slots. If the protrusions are retractable pins, the pins may retract upon moving of the anchor outside of the J-slot in response to the contact of the protrusions with the liner hanger profile.

Figure 5:
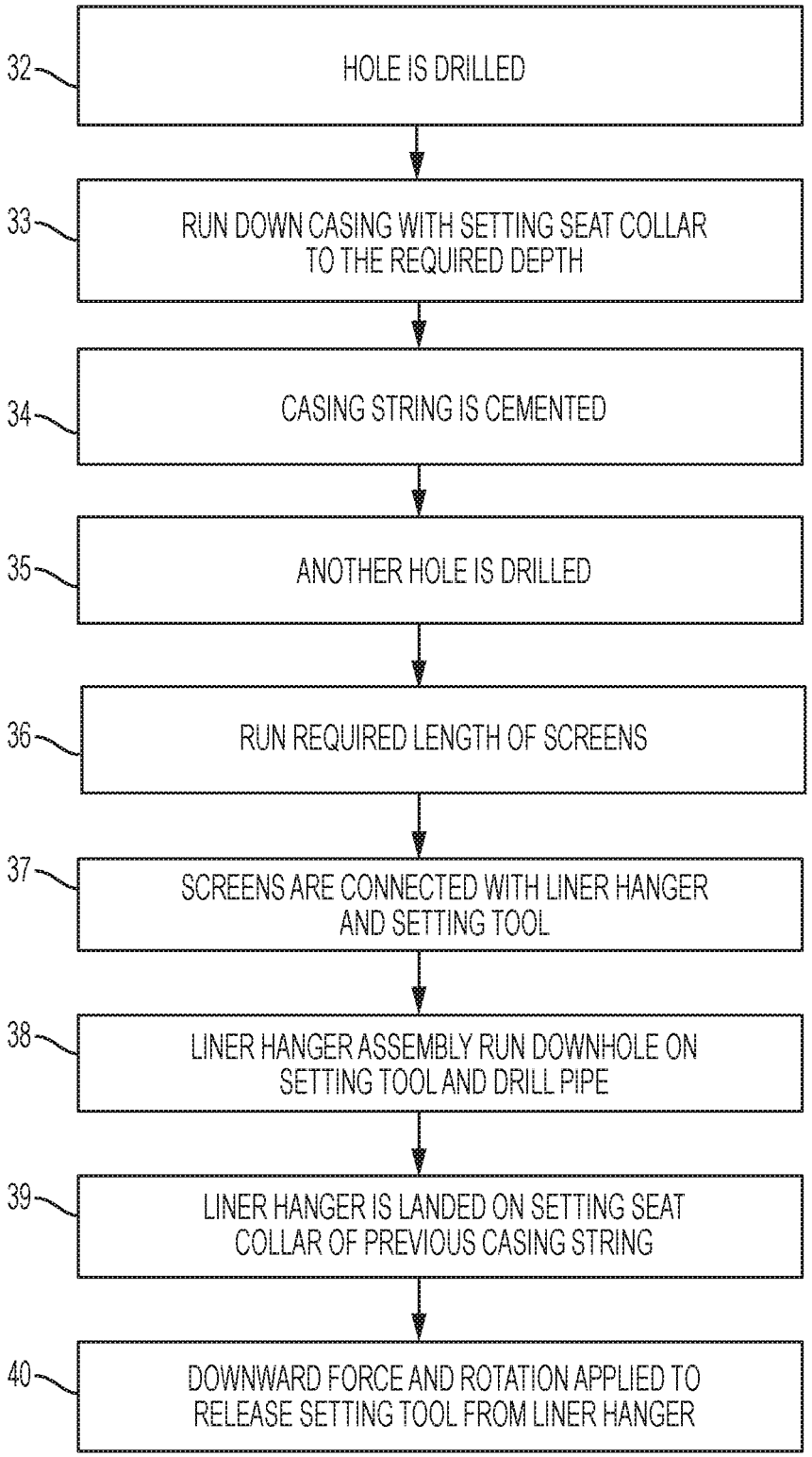
FIG. 5 is a flowchart showing an example process for installing a liner hanger system in a well.

FIG. 5 shows an example process for installing a casing, including a screen, at the completion of a vertical water well using a liner hanger of the type described with respect to FIG. 4, for example. According to the example process, a hole is drilled (32) to accommodate a segment of a casing string in wellbore. Casing is run (33) downhole. The casing and liner hanger may be run downhole on a drill pipe assembly or using any appropriate tool deployed downhole from the surface. The hole may be a hole drilled through a previously installed casing string. The casing may have any appropriate dimensions and configuration. For example, the casing may have the configuration of the casing shown in FIG. 2 or the configuration of the casing shown in FIG. 3. In some implementations, the casing includes a setting seat collar.

After the casing string reaches the required depth, the drill pipe may connect to the previous casing string, for example a 13⅜" casing string, using a stab-in connection. The casing string is cemented (34). Another hole is drilled (35) to extend the wellbore across an aquifer. The hole may be drilled using a tool drilling through the inner diameter of the installed casing string. For example, if the installed casing string is a 9⅝ inch casing string, the inner diameter may be 8½ inches. The hole drilled through the inner diameter of the casing string will be smaller than 8½ inches. If needed, cement may be cleaned out of the shoe track, or the space between float collar and landing collar, using the drill bit and a scraper configured to scrape the setting seat collar.

If the hole that is drilled reaches, or is close to, the well's completion zone, one or more screens may be incorporated into the completion zone. The required length of screens are run (36) in hole. The screens are connected (37) with liner hanger and setting tool and run (38) downhole to bottom. The length of screen to be used may correspond to—for example, equal—the length of the completion zone. In a case where the screen is comprised of more than one segment, the screen segments may be joined to form a screen assembly that is long enough to line the completion zone. The screen assembly is connected to the liner hanger. This may be done, for example, using threads on the liner hanger and complementary threads on the screen. The liner hanger is connected to a setting tool, such as setting tool 22. In this example, setting tool 22 includes anchor 23 to engage and, to connect to, J-slot 31 on inner profile of liner hanger 24.

The liner hanger assembly, including the setting tool, the liner hanger, and the screen, is run (38) downhole on a drill pipe. The liner hanger is landed (39) on a setting seat collar located at a point near to the end of the previous casing string. For example, liner hanger 24 may be landed on setting seat collar 18 of casing string 16. Liner hanger 24 may form a secure stab-in connection with setting seat collar 18. Downward force and rotation is applied (40) to the setting tool to release the setting tool from the liner hanger. For example, downward force is applied to setting tool 22 to slack off the weight of liner hanger 24 and screen 29 and onto the setting seat collar 18. Following release, setting tool 22 is pulled out of the hole to the surface and liner hanger 24, including screen 29, remains seated on setting seat collar 18 downhole. Screen 29 thus remains downhole and lines the completion zone of the wellbore.

Figure 6:
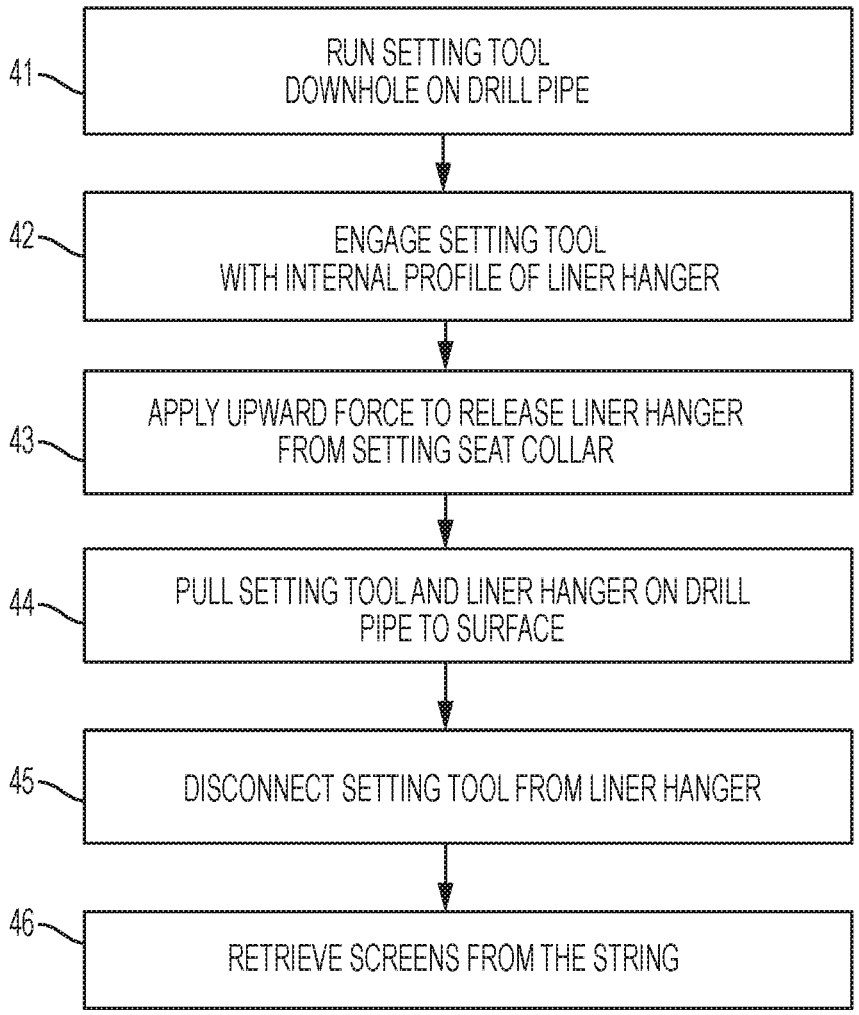
FIG. 6 is a flowchart showing an example process for retrieving a previously-installed liner hanger and casing string from a well.

A liner hanger with screens installed in a well may be retrieved using the example process of FIG. 6. For example, liner hanger 24 landed on setting seat collar 18 may be retrieved using setting tool 22. Referring to FIG. 6, a setting tool is run (41) downhole on a drill pipe to the location of the liner hanger. The setting tool is engaged (42) to the inner profile of the liner hanger. For example, setting tool 22 may be connected to liner hanger 24 by rotating the setting tool until anchor 23 engages, and connects to, J-slot 31 of liner hanger 24. The setting tool is thereby connected to the liner hanger and screen. Upward force is applied (43) to release the liner hanger from setting seat collar. The setting tool connected to the liner hanger and screen is pulled (44) out on drill pipe to the surface. The setting tool is disconnected (45) from the liner hanger. For example, setting tool 22 is disconnected from liner hanger 24 by releasing setting tool anchor 23 from J-slot 31 of liner hanger 24. Setting tool 22 may be rotated within liner hanger 24 to release anchor 23 of setting tool 22 from J-slot 31.

Rotation of the setting tool may be implemented via rotation of the drill pipe at the surface. Afterwards, screens (29) may be retrieved (46) from the string.

The example processes of FIG. 5 and FIG. 6 may include but are not limited to, installing a liner hanger and screen on casing string 11 as shown in FIG. 2 or casing string 16 as shown in FIG. 3. For example, the example process of FIG. 5 may be used to install a 9⅝ inch casing string of the type shown in FIG. 3 onto a 13⅜ inch casing string of the type FIG. 2. For example, outer diameter of casing string 16 may be configured to fit within inner diameter of casing string 11 by excluding setting seat collar 12.

The example systems described in this specification may be implemented in wells that are vertical or for wells that are, in whole or part, non-vertical. For example, the system may be used to install, or to remove, components in vertical well or a deviated well.

The example liner hanger systems described in this specification may be configured to install a casing string or a screen in different types of water wells.

All or part of the systems and processes described in this specification and their various modifications (subsequently referred to as "the systems") may be controlled at least in part, by one or more computers using one or more computer programs tangibly embodied in one or more information carriers, such as in one or more non-transitory machine-readable storage media. A computer program can be written in any form of programming language, including compiled or interpreted languages, and it can be deployed in any form, including as a stand-alone program or as a module, part, subroutine, or other unit suitable for use in a computing environment. A computer program can be deployed to be executed on one computer or on multiple computers at one site or distributed across multiple sites and interconnected by a network.

Actions associated with controlling the systems can be performed by one or more programmable processors executing one or more computer programs to control all or some of the operations described previously. All or part of the systems can be controlled by special purpose logic circuitry, such as, an FPGA (field programmable gate array), an ASIC (application-specific integrated circuit), or both an FPGA and an ASIC.

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the systems described without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A method comprising:

attaching a screen to a liner hanger;

connecting a setting tool to the liner hanger having the screen attached;

running the setting tool connected to the liner hanger into a wellbore, the setting tool being run in the wellbore to a point proximate to an end of a casing lining the wellbore, the casing comprising a collar located proximate to the end of the casing;

securing the liner hanger to the collar; and after the securing, releasing the setting tool from the liner hanger, where releasing comprises applying downward force to the setting tool and, while downward force is applied, rotating the setting tool.

2. The method of claim 1, where the wellbore is for a vertical water well; and where the screen lines at least part of a production zone of the vertical water well.

3. The method of claim 1, where an outer profile of the liner hanger has a first shape that is based on a second shape of an inner profile of the collar.

4. The method of claim 1, where an outer profile of the liner hanger has a first shape that is complementary to a second shape of an inner profile of the collar.

5. The method of claim 1, where the setting tool is configured to connect to the liner hanger using a J-slot mechanism; and where the J-slot mechanism comprises two J-slot structures opposing each other on an inner profile of the liner hanger.

6. A method comprising:

attaching a screen to a liner hanger;

connecting a setting tool to the liner hanger having the screen attached;

running the setting tool connected to the liner hanger into a wellbore, the setting tool being run in the wellbore to a point proximate to an end of a casing lining the wellbore, the casing comprising a collar located proximate to the end of the casing;

securing the liner hanger to the collar; and after the securing, releasing the setting tool from the liner hanger, where connecting the setting tool to the liner hanger comprises connecting an anchor located on the setting tool to a J-slot mechanism on an inside of the liner hanger.

7. The method of claim 6, where releasing the setting tool from the liner hanger comprises applying downward force to the setting tool and rotating the setting tool in order to release the anchor from the J-slot mechanism.

8. A liner hanger system for attaching a screen onto a casing string, the system comprising:

a setting tool;

a setting seat collar disposed on the casing;

a liner hanger disposed below the setting tool and configured to couple thereto, the liner hanger comprising a first set of threads at one end; and a screen disposed below the liner hanger, the screen comprising a second set of threads configured to connect with the first set of threads, thereby coupling the screen to the liner hanger, where an interference fit is formed between the liner hanger and the setting seat collar that produces a frictional force between the liner hanger and the setting seat collar.

9. The system of claim 8, where the setting tool comprises an anchor configured to connect to the liner hanger, the liner hanger further comprising:

an outer profile comprising one or more ridge-like structures; and an inner profile comprising a J-slot configured to connect to the anchor;

where the screen comprises a third set of threads configured to connect to another screen segment forming a screen assembly, where the liner hanger is coupled to the casing string, and where the outer profile is configured to match the inner profile of the setting seat collar on a previously installed casing string.

10. The system of claim 9, where a length of the screen assembly is about equal to a length of a completion zone of a wellbore in which the system is disposed.

* * * * *